US006886730B2

(12) United States Patent
Fujisawa et al.

(10) Patent No.: US 6,886,730 B2
(45) Date of Patent: May 3, 2005

(54) COMBUSTION-POWERED DRIVING TOOL

(75) Inventors: Haruhisa Fujisawa, Hitachinaka (JP); Yasuki Ohmori, Hitachinaka (JP); Tomomasa Nishikawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/870,932

(22) Filed: Jun. 21, 2004

(65) Prior Publication Data

US 2005/0001004 A1 Jan. 6, 2005

(30) Foreign Application Priority Data

Jun. 20, 2003 (JP) ..... 2003-176591
May 7, 2004 (JP) ..... 2004-139263

(51) Int. Cl.[7] ..... B25C 1/08

(52) U.S. Cl. ..... 227/8; 227/10; 227/130; 123/46 SC

(58) Field of Search ..... 227/2, 8, 10, 130, 227/136, 131; 123/46 R, 46 SC, 630

(56) References Cited

U.S. PATENT DOCUMENTS 5,133,329 A * 7/1992 Rodseth et al. ..... 123/630
5,197,646 A * 3/1993 Nikolich ..... 227/8
5,592,580 A * 1/1997 Doherty et al. ..... 388/815
5,680,980 A * 10/1997 Robinson ..... 227/10
5,752,643 A * 5/1998 MacVicar et al. ..... 227/10
6,006,704 A * 12/1999 Phillips et al. ..... 123/46 SC
6,260,519 B1 * 7/2001 Phillips ..... 123/46 R
6,739,490 B1 * 5/2004 Shkolnikov et al. ..... 227/2

* cited by examiner

*Primary Examiner*—Scott A. Smith
(74) *Attorney, Agent, or Firm*—Antonelli, Terry, Stout & Kraus, LLP

(57) ABSTRACT

A combustion-powered driving tool for driving nails or other fasteners in which the starting characteristics of a motor in the tool are improved by varying the amount of voltage applied to the motor when starting the motor and during normal operations so that the motor is driven to reach the rotational speed required in normal operations quickly. Therefore, the combustion-powered driving tool does not require the use of an expensive low-inertia motor, but can use a relatively inexpensive core-type motor or the like with inferior starting characteristics, while improving the work efficiency and user-friendliness of the combustion-powered driving tool.

14 Claims, 10 Drawing Sheets

COMBUSTION-POWERED DRIVING TOOL

BACKGROUND OF THE INVENTION

1. Field of the Invention

The present invention relates to a combustion-powered tool, and more particularly to a combustion-powered, fastener-driving tool for driving nails or other fasteners. In such a fastener-driving tool, liquefied gas contained in a gas tank is injected into a combustion chamber, where the liquefied gas is mixed with air and ignited. The power generated from this combustion drives a piston, which in turn drives the nail or other fastener into a workpiece.

2. Description of the Related Art

Combustion-powered tools of the type described above are disclosed in U.S. Pat. Nos. 4,483,474; 4,403,722; 4,522,162 and 5,592,580. A typical combustion-powered tool primarily includes a housing, handle, trigger switch, head cap, combustion chamber frame, push lever, cylinder, piston, driver blade, motor, fan, gas tank, spark plug, exhaust check valve, magazine, and tail cover. The head cap seals one end of the housing. The handle is fixed to the housing and includes a trigger switch, as well as a built-in battery. The combustion chamber frame is disposed inside the housing and is capable of moving in the lengthwise direction thereof. A spring urges the combustion chamber frame in a direction away from the head cap, but the frame is capable of opposing the urging force of the spring to contact the head cap with an end nearest the same.

The push lever is movably disposed on the opposite end of the housing from the head cap and is coupled with the combustion chamber frame. The cylinder is fixed to the housing at a position enabling the cylinder to be in fluid communication with the combustion chamber frame for guiding the movement of the frame. Exhaust holes are formed in the cylinder. The piston is capable of sliding in a reciprocating motion in the cylinder. When the end of the combustion chamber frame contacts the head cap, a combustion chamber is formed by the head cap, the combustion chamber frame, the cylinder, and the end of the cylinder nearest the head cap. The driver blade extends from the side of the piston opposite the combustion chamber to the other end of the housing. The motor is supported on the head cap. The fan is positioned in the combustion chamber and fixed to the motor. When driven by the motor, the fan accelerates combustion by creating a turbulent flow with respect to combusted gas, non-combusted gas, and air in the combustion chamber. The fan also introduces outside air into the housing when the combustion chamber frame separates from the head cap to clear gas out of the combustion chamber frame and functions to cool the peripheral sides of the cylinder. The gas tank is accommodated in the housing and contains a liquefied flammable gas that can be injected into the combustion chamber via a channel formed in the head cap. The spark plug is exposed in the combustion chamber for igniting the mixture of flammable gas and air. The exhaust check valve selectively covers the exhaust holes.

The magazine is disposed on the end of the housing opposite the head cap and accommodates nails or other fasteners. The tail cover is provided between the magazine and the push lever for supplying a fastener from the magazine to a position aligned with the driver blade.

In order to hermetically seal the combustion chamber when the combustion chamber frame contacts the head cap, a sealing member (seal ring) is provided one on a prescribed surface of the head cap that contacts the top part of the combustion chamber frame and one on the edge of the cylinder on the head cap side that contacts the bottom of the combustion chamber frame.

When the push lever is pressed against a workpiece, the combustion chamber is formed; liquefied gas from the gas tank mounted in the housing is injected into the combustion chamber; and the fan mixes air with the flammable gas. If the trigger switch is operated at this time, the spark plug ignites the gas-air mixture, causing explosive combustion. This combustion drives the piston and, consequently, the driver blade, to drive a nail into a workpiece, such as wood. The combustion chamber frame is maintained in contact with the head cap for a prescribed time after the explosive combustion. After exhausting the gas, the exhaust check valve is closed to seal the combustion chamber, and a thermal vacuum is obtained on the combustion chamber side when a drop in temperature causes the pressure in the combustion chamber to drop. As a result, the piston rises due to the pressure differential above and below the piston.

The above-described conventional combustion-powered driving tool is involved with the following drawbacks.

(1) Pressing the push lever against the workpiece switches on a head switch (or push switch). The head switch (or push switch) actuates the motor, which drives the fan to rotate. When the user operates the trigger switch, the spark plug fires, igniting the gas-air mixture. However, if the trigger switch is operated in a relatively short time period after the motor and the fan begin to rotate, the motor and fan have not yet reached a rotational speed capable of producing a sufficient driving force. In such cases, a low driving force is produced.

There have been proposals for overcoming this problem that include use of an expensive low-inertia motor, or "coreless" motor, and methods for regulating the interval from the point that the head switch (or push switch) is turned on until the gas-air mixture is ignited. However, these methods are expensive and greatly reduce work efficiency and user-friendliness.

(2) A secondary battery is used as a power source for driving the motor and igniting the sparkplug. An extra battery needs to be provided when the tool is used continuously or used frequently over a long period of time.

(3) When the tool is used under a low temperature circumstance, the liquefied gas injected into the combustion chamber is not sufficiently vaporized and thus cannot be mixed with air. In such a condition, explosive combustion does not occur even if the trigger switch is turned ON. Re-triggering the switch does not cause the explosive combustion to occur. The tool has to be separated from the workpiece and is again pressed against the workpiece to inject the liquefied gas into the combustion chamber. If this procedure is taken, explosive combustion may be taken place when the trigger switch is again turned ON. However, repeated injection of the liquefied gas consumes the gas in vain and the duration of time the tool is continuously usable with the loaded gas tank is shortened.

(4) Because a high voltage is applied to an electric circuit accommodated in the tool and a large current is flowing therein when the tool is operating, a voltage caused by noises is induced on the wiring of the tool, which prevents the tool from operating normally.

SUMMARY OF THE INVENTION

In view of the foregoing, it is an object of the present invention to provide a combustion-powered tool that is cheaper and more efficient and user-friendly than the combustion-powered tool of the prior art.

It is another object of the present invention to provide a combustion-powered tool that can be used for a long period of time without replacing a gas tank.

In order to achieve the above and other objects, there is provided according to one aspect of the invention a combustion-powered driving tool for driving fasteners into a workpiece, that includes a housing, a head section, a motor, a battery, a motor drive controlling section, a cylinder, a piston, a combustion chamber frame, a fan, and a sparkplug. The head section seals one end of the housing and has a flammable gas channel formed therein. The motor drive controlling section is supplied with the operating voltage of the battery and controls a voltage applied to the motor. The piston is slidably movably disposed inside the cylinder. The combustion chamber frame moves to contact and separate from the head section and forms a combustion chamber together with the head section, the cylinder, and the piston when the combustion chamber frame is in contact with the head section. The fan is rotatably disposed in the combustion chamber and driven to rotate by the motor. The sparkplug is exposed in the combustion chamber for igniting a mixture of air and flammable gas in the combustion chamber. The flammable gas is supplied into the combustion chamber via the flammable gas channel. Explosive combustion caused by firing of the sparkplug moves the piston and a fastener is driven into the workpiece in accordance with the movement of the piston. The motor drive control section applies a first voltage to the motor when the combustion chamber is formed by the combustion chamber frame moving toward and brought into contact with the head section, and a second voltage to the motor, wherein the first voltage is greater than the second voltage.

The motor drive controlling section may include an up converter that steps up the operating voltage of the battery and outputs a stepped up voltage. The motor drive controlling section applies the stepped up voltage to the motor as the first voltage. In this case, the motor drive controlling section may apply the operating voltage of the battery to the motor as the second voltage.

Alternatively, the motor drive controlling section may include a down converter that steps down the operating voltage of the battery and outputs a stepped down voltage. The motor drive controlling section applies the stepped down voltage to the motor as the second voltage. In this case, the motor drive controlling section may apply the operating voltage of the battery to the motor as the first voltage.

It is preferred that with the first voltage applied to the motor, the motor reach to the steady rotational speed within 130 ms.

The motor drive control section may apply a third voltage to the motor after the explosive combustion is taken place, wherein the second voltage is greater than the third voltage.

According to another aspect of the invention, there is provided a combustion-powered driving tool for driving fasteners into a workpiece, that includes a housing, a head section, a motor, a battery, a power source section, a motor drive controlling section, a first switch, a second switch, a cylinder, a piston, a combustion chamber frame, a fan, a sparkplug, and a controller. The head section seals one end of the housing and has a flammable gas channel formed therein. The power source section is supplied with the operating voltage of the battery and generates a reference voltage. The motor drive controlling section is supplied with the operating voltage of the battery and the reference voltage from the power source section and drives the motor based on the operating voltage and the reference voltage. The first switch detects whether the tool is pressed against the workpiece and outputs a first signal indicative of a detected condition. The second switch instructs driving the fastener into the workpiece and outputs a second signal indicative of an instruction to drive the fastener. The combustion chamber frame moves to contact and separate from the head section and forms a combustion chamber together with the head section, the cylinder, and the piston when the combustion chamber frame is in contact with the head section. The fan is rotatably disposed in the combustion chamber and driven to rotate by the motor. The sparkplug is exposed in the combustion chamber for igniting a mixture of air and flammable gas in the combustion chamber. The flammable gas is supplied into the combustion chamber via the flammable gas channel, wherein explosive combustion caused by firing of the sparkplug moves the piston toward the second end of the housing and a fastener is driven into the workpiece in accordance with the movement of the piston. The controller controls the power source section so as not to generate the reference voltage in order to reduce power consumption when at least one of the first signal and the second signal indicates that the tool is left unused for a prescribed period of time. The controller may further control the power source section so as not to generate the reference voltage in order to reduce power consumption when at least one of the first signal and the second signal indicates that at least one of the first switch and the second switch malfunctions.

According to still another aspect of the invention, there is provided a combustion-powered driving tool for driving fasteners into a workpiece, that includes a housing, a head section for sealing one end of the housing and having a flammable gas channel formed therein, a motor, a battery for supplying an operating voltage, a power source section that is supplied with the operating voltage of the battery, a motor drive controlling section that is supplied with the operating voltage of the battery and drives the motor, a first switch that detects whether the tool is pressed against the workpiece and outputs a first signal indicative of a detected condition, a second switch that instructs driving the fastener into the workpiece and outputs a second signal indicative of an instruction to drive the fastener, a cylinder, a piston slidably movably disposed inside the cylinder, a combustion chamber frame that moves to contact and separate from the head section and that forms a combustion chamber together with the head section, the cylinder, and the piston when the combustion chamber frame is in contact with the head section, a fan rotatably disposed in the combustion chamber and driven to rotate by the motor, a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston, and a controller that actuates the sparkplug to ignite the mixture of air and flammable gas in the combustion chamber in response to the second signal and regardless of the first signal.

According to further aspect of the invention, there is provided a combustion-powered driving tool for driving fasteners into a workpiece, that includes a housing, a head section for sealing one end of the housing and having a flammable gas channel formed therein, a motor, a battery for supplying an operating voltage, a power source section that is supplied with the operating voltage of the battery and generates a reference voltage, a motor drive controlling section that is supplied with the operating voltage of the battery and the reference voltage from the power source section and that drives the motor based on the operating voltage and the reference voltage, a first switch that detects whether the tool is pressed against the workpiece and outputs a first signal indicative of a pressed condition of the tool, a second switch that instructs driving the fastener into the workpiece and outputs a second signal indicative of an instruction to drive the fastener, a third switch that connects the battery and the power source section when turned ON, a cylinder, a piston slidably movably disposed inside the cylinder, a combustion chamber frame that moves to contact and separate from the head section and that forms a combustion chamber together with the head section, the cylinder, and the piston when the combustion chamber frame is in contact with the head section, a fan rotatably disposed in the combustion chamber and driven to rotate by the motor, a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston, and a controller that is supplied with the reference voltage from the power source section when the third switch is ON, wherein the controller is rendered inoperative when neither the first signal nor the second signal is output even if the third switch is ON.

According to yet another aspect of the invention, there is provided a combustion-powered driving tool for driving fasteners into a workpiece, that includes a housing, a head section for sealing one end the housing and having a flammable gas channel formed therein, a motor, a battery for supplying an operating voltage, a power source section that is supplied with the operating voltage of the battery and generates a reference voltage, a motor drive controlling section that is supplied with the operating voltage of the battery and the reference voltage from the power source section and that drives the motor based on the operating voltage and the reference voltage, a first switch that detects whether the tool is pressed against the workpiece and outputs a first signal indicative of a pressed condition of the tool, a second switch that instructs driving the fastener into the workpiece and outputs a second signal indicative of an instruction to drive the fastener, a cylinder, a piston slidably movably disposed inside the cylinder, a combustion chamber frame that moves to contact and separate from the head section and that forms a combustion chamber together with the head section, the cylinder, and the piston when the combustion chamber frame is in contact with the head section, a fan rotatably disposed in the combustion chamber and driven to rotate by the motor, a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston, and a controller that generates a start signal instructing to drive a fastener into the workpiece. The fastener is driven into the workpiece when both the second signal and the start signal are generated.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
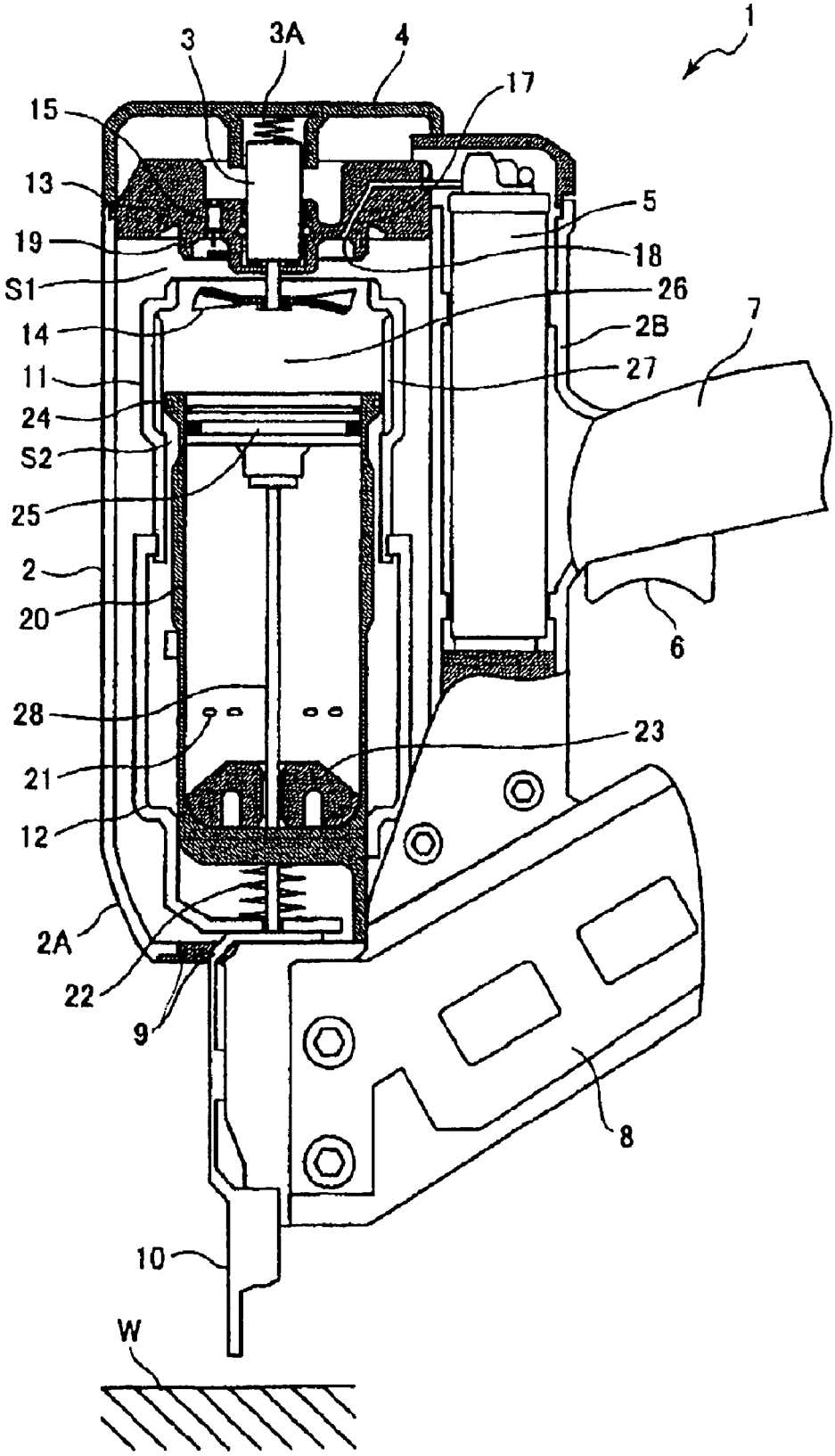
FIG. 1 is a cross-sectional view showing a combustion-powered driving tool according to a first embodiment of the invention.

Next, a first embodiment will be described while referring to FIGS. 1, 2 and 3A–3B, wherein the combustion-powered tool of the present invention is applied to a combustion-powered, fastener-driving tool. In the following description, it is assumed that the tool is held in an orientation in which nails are fired toward a downward direction.

A combustion-powered, fastener-driving tool 1 has a housing 2 that forms an outer framework. The housing 2 includes a main housing section 2A and a tank chamber 2B provided alongside the main housing section 2A in the lengthwise direction. An intake hole (not shown) is formed in the top of the main housing section 2A, while an exhaust hole (not shown) is formed in the bottom of the same.

A head cover 4 is mounted on the top of the main housing section 2A. A gas tank 5 containing flammable gas is removably accommodated in the tank chamber 2B. A handle 7 extends outward from the tank chamber 2B. The handle 7 is provided with a trigger switch 6 and a built-in battery 30 (see FIG. 2) having a nominal voltage of 7.2 V, for example. Disposed below the main housing section 2A and the tank chamber 2B are a magazine 8 loaded with nails (not shown) and a tail cover 9 for guiding the nails in the magazine 8 to a prescribed position.

A push lever 10 is movably supported on the bottom end of the main housing section 2A with respect to the position of the nail set by the tail cover 9. A coupling unit 12 fixed to a combustion chamber frame 11 described later is joined to the push lever 10. When the tip of the push lever 10 contacts a workpiece W and the entire housing 2 is pushed in a direction toward the workpiece W, the upper portion of the push lever 10 can recede into the main housing section 2A.

A head cap 13 is fixed in the top end of the main housing section 2A. A motor 3 is supported in the head cap 13 by a spring 3A. A fan 14 is fixed to a rotational shaft of the motor 3. A spark plug 15 that fires when the trigger switch 6 is operated is also retained in the head cap 13. A head switch 16 (see FIG. 2) is provided in the main housing section 2A for detecting that the combustion chamber frame 11 is at the top end of a stroke when the entire tool is pressed against the workpiece W. When the push lever 10 rises to a prescribed position, the head switch 16 is switched on, activating the motor 3, which in turn begins rotating the fan 14. The fan 14 is configured from a hub and six vanes equally spaced apart around the hub and extending outwardly from the hub. The fan 14 rotates at a rate of approximately 12,000 rpm.

A fuel injection channel 17 is formed in the side of the head cap 13 nearest the tank chamber 2B. An end of the fuel injection channel 17 penetrating the bottom surface of the head cap 13 forms an injection nozzle 18, while the other end forms a connector for connecting to the gas tank 5. A first sealing member 19 formed of an O-ring is mounted on the head cap 13 for forming a seal between the head cap 13 and the combustion chamber frame 11 when the top of the combustion chamber frame 11 is placed in contact with the head cap 13.

The combustion chamber frame 11 disposed in the main housing section 2A is capable of reciprocating movement in the lengthwise direction of the main housing section 2A and is capable of contacting the bottom surface of the head cap 13. As described above, the coupling unit 12 is joined with the push lever 10 and fixed to the bottom end of the combustion chamber frame 11. Accordingly, the combustion chamber frame 11 moves along with the movement of the push lever 10. A cylinder 20 is fixed to the main housing section 2A for guiding movement of the combustion chamber frame 11 by contacting the inner wall of the same. A compressed coil spring 22 is interposed between the bottom surface of the cylinder 20 and the coupling unit 12 for urging the combustion chamber frame 11 away from the head cap 13. Exhaust holes 21 are formed near the bottom of the cylinder 20 and are in fluid communication with the exhaust hole in the main housing section 2A described above. A check valve (not shown) is provided on the outer side of the exhaust holes 21 for selectively blocking the same. A bumper 23 is also provided in the bottom of the cylinder 20. A second sealing member 24 formed of an O-ring is mounted on the top of the cylinder 20 for forming a seal between the inner wall near the bottom of the combustion chamber frame 11 and the outer wall near the top of the cylinder 20 when the combustion chamber frame 11 contacts the head cap 13.

A piston 25 capable of reciprocating movement while sliding against the inner wall of the cylinder 20 is provided inside the cylinder 20. When the top end of the combustion chamber frame 11 contacts the head cap 13, a combustion chamber 26 is formed by the head cap 13, the combustion chamber frame 11, the end of the cylinder 20 nearest the head cap, the piston 25, and the first and second sealing members 19 and 24. When the combustion chamber frame 11 separates from the head cap 13, a first channel S1 in fluid communication with the outside air forms between the head cap 13 and the top end of the combustion chamber frame 11, and a second channel S2 in communication with the first channel S1 forms between the bottom end of the combustion chamber frame 11 and the top end of the cylinder 20. The second channel S2 allows combustion gas and fresh air to pass outside the cylinder 20 and to be discharged through the exhaust hole in the main housing section 2A.

A plurality of ribs 27 is provided on the section of the combustion chamber frame 11 forming the combustion chamber 26, extending in the axial direction of the combustion chamber frame 11 and protruding radially inwardly. In cooperation with the rotation of the fan 14, the ribs 27 promote the mixture of air and flammable gas in the combustion chamber 26 through agitation. The intake hole described above that is formed in the top of the main housing section 2A supplies air into the combustion chamber 26, while combustion gas in the combustion chamber 26 is discharged through the exhaust holes 21 and the exhaust hole formed in the bottom of the main housing section 2A.

A driver blade 28 extends from the side of the piston 25 opposite the combustion chamber 26 to the end of the main housing section 2A. The driver blade 28 is capable of impacting a nail in the tail cover 9 along the same axis as the nail. When propelled downward, the piston 25 collides with the bumper 23 and stops.

The fan 14, spark plug 15, and injection nozzle 18 are all disposed in or exposed in the combustion chamber 26. The fan 14 achieves three functions. First, before the spark plug 15 fires, rotation of the fan 14 mixes air and flammable gas in the combustion chamber 26 by agitation when the combustion chamber frame 11 is contacting the head cap 13. Second, when the spark plug 15 fires, rotation of the fan 14 generates a turbulent flow that promotes combustion. Third, when the combustion chamber frame 11 separates from the head cap 13 after driving the nail, the first and second channels S1 and S2 are formed and the fan 14 functions to clear combustion gas from the combustion chamber 26 and to cool the cylinder 20.

Figure 2:
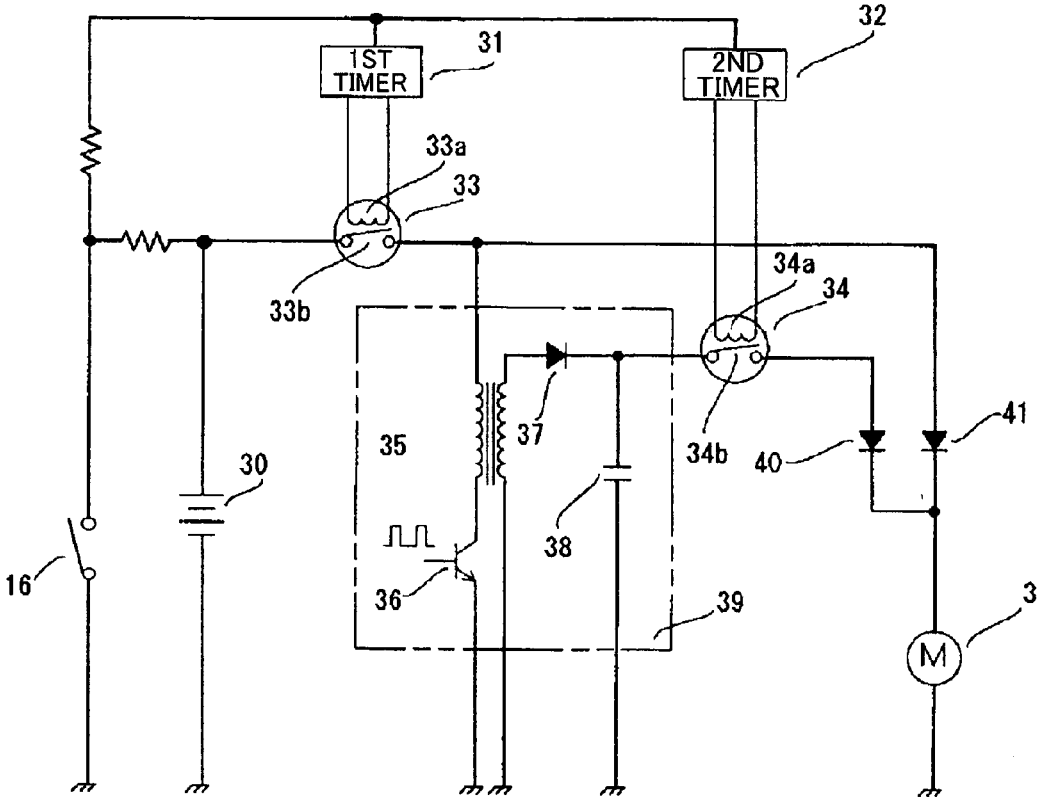
FIG. 2 is a block circuit diagram showing a control circuit for controlling the voltage applied to the motor according to the first embodiment of the invention.

FIG. 2 shows a control circuit incorporated in the tool 1 shown in FIG. 1. The control circuit controls the operating voltage of the motor 3 to drive the fan 14. When the head switch 16 is closed, a first timer 31 and a second timer 32 operate for a prescribed interval and energize associated exciting coils 33*a* and 34*a* of relay switches 33 and 34, respectively. While the exciting coils 33*a* and 34*a* are energized, the relay switches 33 and 34 close contacts 33*b* and 34*b*. When the relay contact 33*b* is closed, a voltage converter 39 increases the voltage of the battery 30 (7.2 V) to 12 V and applies the 12 V to the motor 3 via the contact 34*b* and a diode 40. After the time measured by the second timer 32 has elapsed, the contact 34*b* is opened and the voltage of 7.2 V from the battery 30 is applied to the motor 3 via the contact 33*b* and a diode 41. Here, the voltage converter 39 is configured of a step-up transformer 35, a switching transistor 36 that repeatedly turns on and off in a prescribed cycle, a diode 37, and a capacitor 38. Thus, the voltage converter 39 operates as an up converter.

Figure 3A:
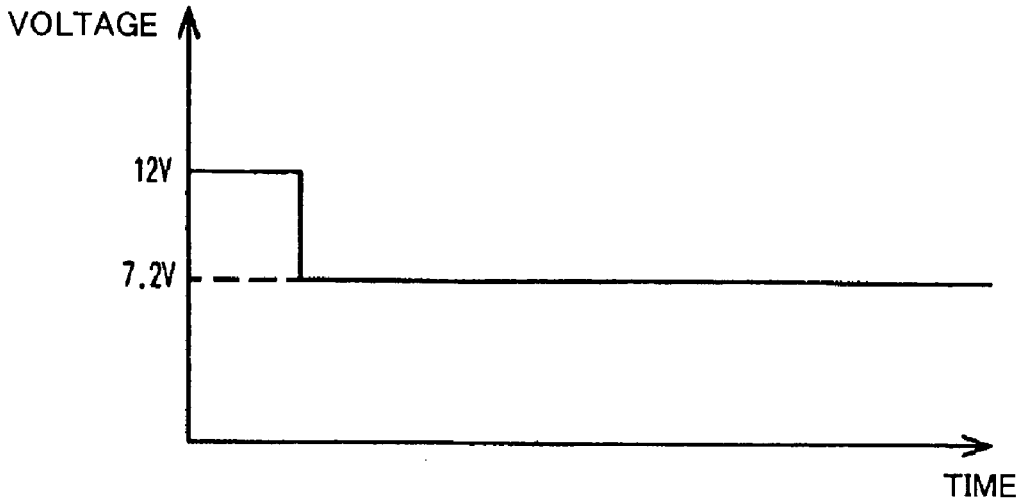
FIG. 3A is a time chart showing the changes in voltage applied to the motor when using the circuit in FIG. 2.
Figure 3B:
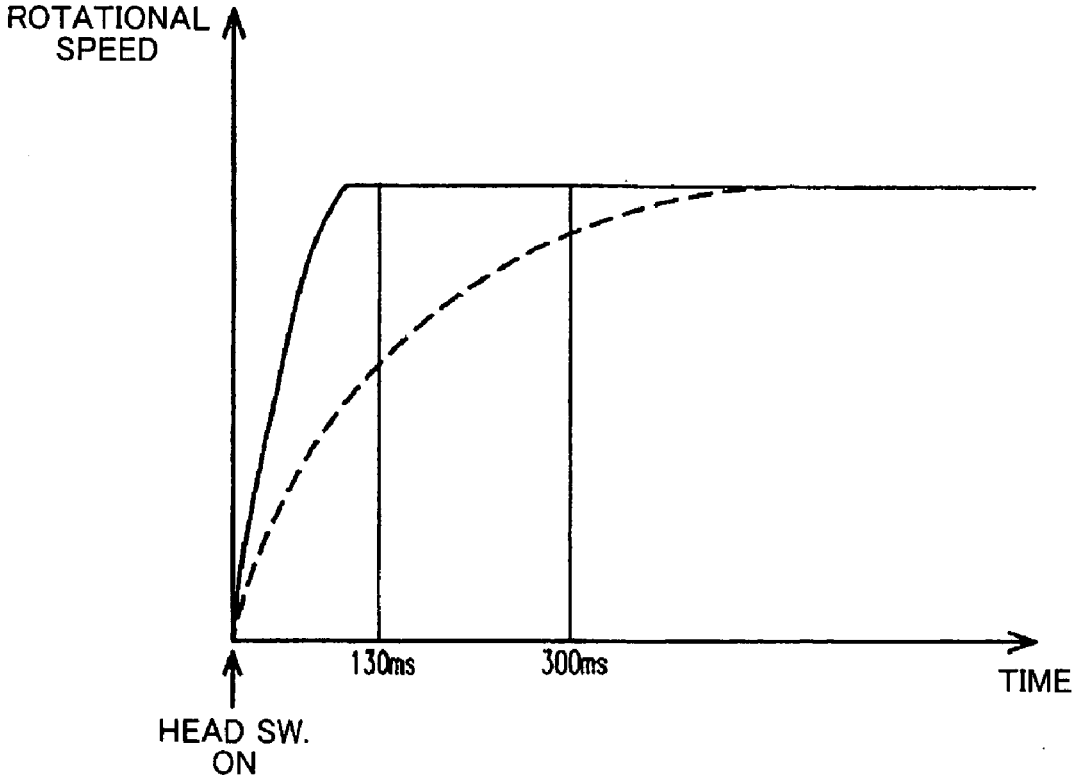
FIG. 3B is a time chart of the rotational speed of the motor when using the circuit in FIG. 2.

FIG. 3A is a timing chart showing the voltage applied to the motor 3 and FIG. 3B is a timing chart showing the rotational speed of the motor 3. The solid line indicates the applied voltage and rotational speed according to the first embodiment of the invention, while the dotted line indicates the rotational speed when the voltage applied to the motor 3 is not controlled and only the nominal voltage of 7.2 V from the battery 30 is applied.

As is clear from FIGS. 3A and 3B, the rotational speed of the motor 3 indicated by the solid line rises quickly when the voltage applied to the motor 3 is increased from the nominal voltage of 7.2 V to 12 V, reaching the prescribed rotational speed (12,000 rpm in the first embodiment) in less than 130 ms. When only the nominal voltage is used, the motor 3 does not reach the prescribed rotational speed even after 300 ms has elapsed, as indicated by the dotted line.

Therefore, the time measured by the second timer 32 is set less than or equal to 130 ms from the moment the head switch 16 is closed, while the time measured by the first timer 31 begins from the moment the head switch 16 is closed and ends at the moment when a prescribed time has elapsed after the head switch 16 is opened. More specifically, the time to be measured by the first timer 31 is set to a length that allows the combustion chamber 26 to be opened after driving the nail and fresh air to be introduced into the combustion chamber 26.

From the perspective of energy conservation, the circuit in FIG. 2 is problematic in that the step-up transformer 35 consumes a large amount of power. However, it was found that the rotational speed of the motor 3 can still be increased quickly by applying the nominal voltage of 7.2 V from the battery 30 when exciting the motor 3 and stepping down the battery voltage to 6 V, for example, during normal operations. In this case, the number of turns in the coil of the motor 3 or the like can be set so that the rotational speed of the motor 3 reaches 12,000 rpm during normal operations with an applied voltage of 6 V. In this connection, the number of turns in the coil of the motor 3 reaches 12,000 rpm during normal operations with an applied voltage of 6 V. In this connection, the number of turns in the coil of the motor 3 according to the first embodiment described above has also been set to achieve a rotational speed of 12,000 rpm with an applied voltage of 7.2 V.

In contrast to the conventional combustion-powered fastener-driving tool employing a fan with four vanes, the tool 1 according to the first embodiment of the invention employs the fan 14 having six vanes. With this increase in the number of vanes, scavenging time can be shortened as compared with the conventional tool. With the same scavenging time, the voltage applied to the motor 3 can be decreased, so that power can be conserved.

A combustion-powered driving tool having the construction described above enables the motor that drives the fan to start rapidly so that the fan can quickly reach the rotational speed for normal operations. Accordingly, the flammable gas and air can be reliably mixed through agitation to ensure that operations are reliable and simple, thereby improving work efficiency and user-friendliness. Since it is not necessary to use an expensive low-inertia motor, the present invention can provide an inexpensive combustion-powered driving tool.

The combustion-powered driving tool described above makes it possible to conserve energy, thereby increasing the life of the battery. Also, the tool makes it possible to achieve rapid driving, thereby improving user-friendliness.

Figure 4:
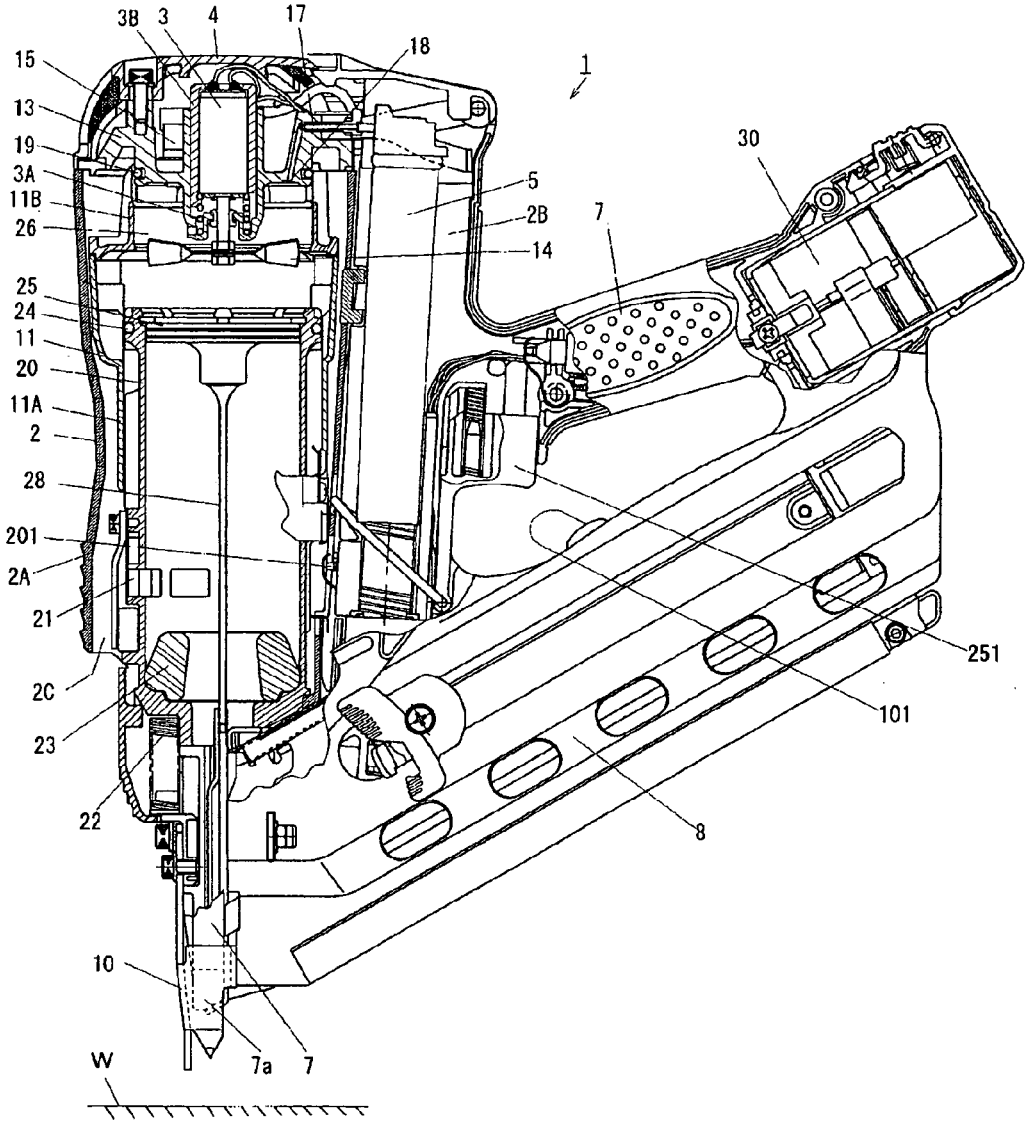
FIG. 4 is a cross-sectional view showing a combustion-powered driving tool according to a second embodiment of the invention.
Figure 5:
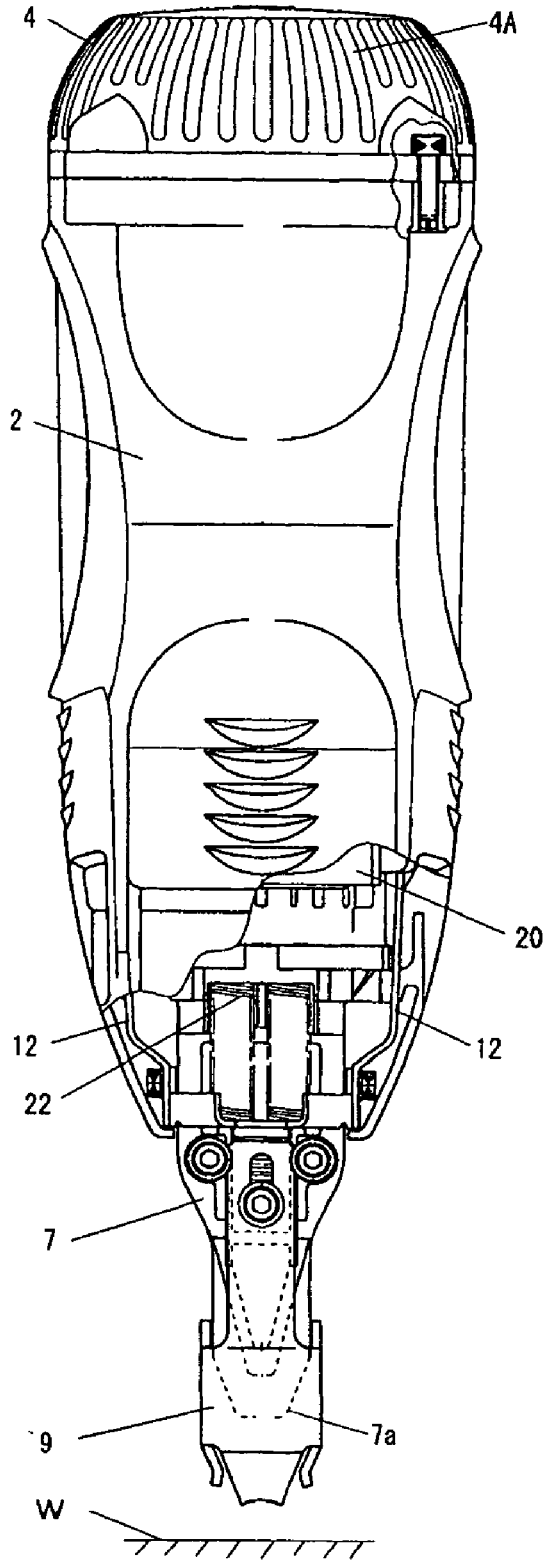
FIG. 5 is a side view showing the combustion-powered driving tool shown in FIG. 4.

A combustion-powered, fastener-driving tool according to a second embodiment of the invention will be described while referring to FIGS. 4 through 9 where like components and parts as appeared in FIG. 1 are designated by like reference numerals and duplicate description thereof is omitted. In FIG. 4, reference numerals 251 and 201 designate a trigger switch and a push switch that function similar to the trigger switch 6 and the head switch 16 of FIGS. 1 and 2, respectively.

In the vicinity of the trigger switch 251 and above the magazine 8, a main switch 101 is disposed. When the main switch 101 is closed or turned ON, the voltage across the battery 30 is applied to a control circuit 51 shown in FIGS. 6A and 6B and the tool 1 is placed in a usable condition. On the other hand, when the main switch 101 is opened or turned OFF, the control circuit 51 is not powered. Therefore, by turning the main switch 101 OFF, it is possible to block dissipation of energy of the battery 30 when the tool 1 is not used.

The push switch 201 is provided in the lower part of the housing 2. Similar to the head switch of the first embodiment, the push switch 201 detects that the combustion chamber frame 11 is at the top end of a stroke when the tool 1 is pressed against the workpiece W.

Figure 6A:
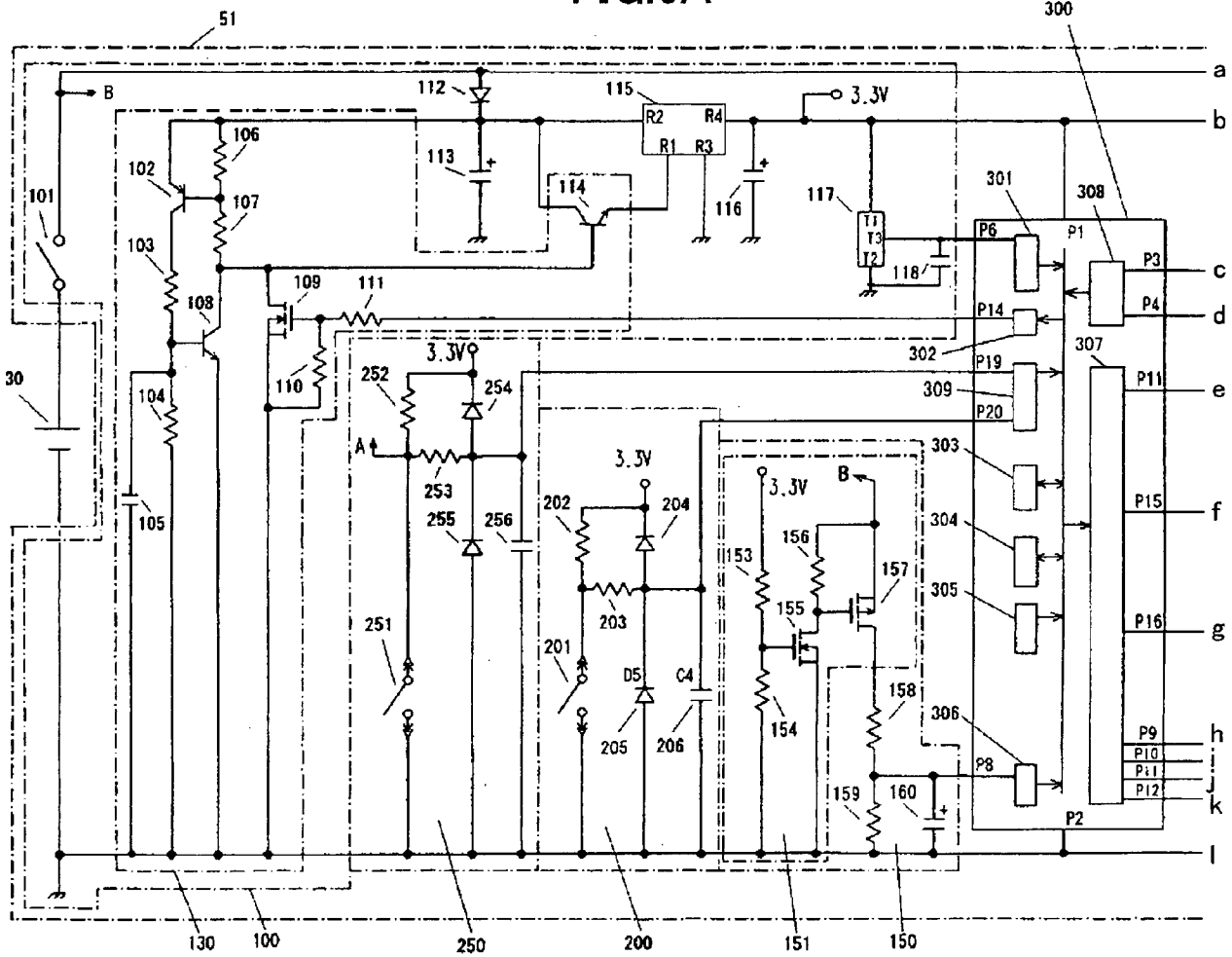
FIG. 6A is a part of a circuit diagram showing a control circuit for controlling the voltage applied to the motor according to the second embodiment of the invention.
Figure 6B:
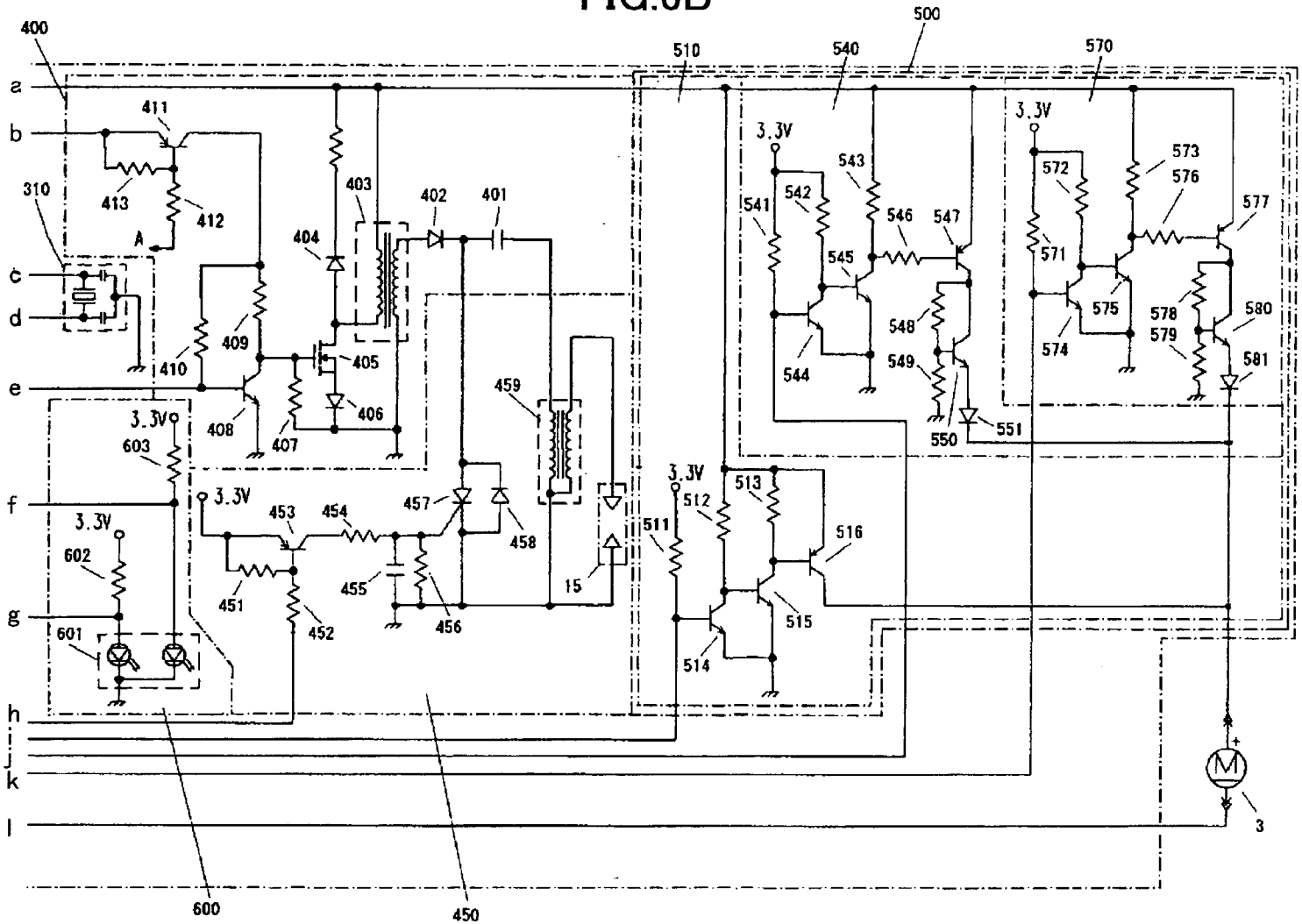
FIG. 6B is a remaining part of the circuit diagram showing the control circuit according to the second embodiment of the invention, wherein combining the circuit diagrams in FIGS. 6A and 6B in relevant portions provides an entire circuit diagram.

FIGS. 6A and 6B show a circuit diagram of the control circuit 51 according to the second embodiment of the invention. It should be noted that FIG. 6A shows a part of the control circuit 51 and FIG. 6B shows a remaining part thereof. Combining the two diagrams in relevant portions provides the entire circuit diagram. The control circuit 51 is configured from a power source section 100, a battery voltage detecting section 150, a push switch section 200, a trigger switch section 250, a microcomputer 300, an oscillator 310, a charging circuit section 400, an ignition circuit section 450, a motor drive controlling section 500, and a display section 600.

The power source section 100 includes a main switch 101, a regulator 115 for generating a drive voltage of the microcomputer 300 and reference voltages, an FET 109, transistors 102, 108, 114, a diode 112, capacitors 105, 113, 116, 118, and resistors 103, 104, 106, 107, 110, 111.

The voltage of the battery 30 (7.2 V) is applied to the regulator 115 through the diode 112 and the regulator 115 generates a voltage (3.3 V) for operating the control circuit 51. The regulator 115 has a terminal R1 for controlling the output from the regulator 115. The power source section 100 further includes a self-holding circuit 130 for holding an output stop signal from the P14 terminal of the microcomputer 300. The output stop signal is for stopping the voltage output from the regulator 115. The output stop signal is held by the self-holding circuit 130 even after the microcomputer 300 is not powered. To stop the voltage output from the regulator 115, the microcomputer 300 outputs a HIGH signal from its P14 terminal, causing the FET 109 to turn ON which in turn causes the transistor 114 to turn OFF and the transistors 102 and 108 to turn ON. Thus, the output stop signal is transmitted to the regulator 115. When the voltage output from the regulator 115 is stopped, the output stop signal, which has been supplied from the P14 terminal of the microcomputer 300, is no longer supplied therefrom. However, due to the self-holding circuit 130, the transistor 108 is held ON in the absence of the output stop signal. This condition continues as far as the battery 30 is not removed or the main switch 101 is not turned OFF. Hence, the control circuit 51 is placed in a low power consumption mode in which the voltage is not output from the regulator 115. Under the low power consumption mode, the tool is not capable of being operated. The low power consumption mode can be canceled by turning OFF the main switch 101 and then turning ON the main switch 101 again.

Generation of the output stop signal from the microcomputer 300 can prevent the battery 30 from being consumed in vain when the tool 1 is left unused for a long period of time while switching ON the main switch 101. The same is true when the tool 1 is rested with the push lever 10 held in a pressed condition and the push switch 201 switched to ON, and when the contact point of the push switch 201 is melted and normally held ON.

A reset IC 117 is connected to the P6 terminal of the microcomputer 300 and outputs a reset signal thereto when the battery 30 is loaded and the main switch 101 is turned ON or when the output voltage from the regulator 115 is out of a set range.

The battery voltage detecting section 150 includes a voltage detection stop circuit 151, a pair of voltage division resistors 158 and 159, and a capacitor 160. The voltage detection stop circuit 151 is configured of FETs 155, 157, and resistors 153, 154, 156. When the power source section 100 is placed in the low power consumption mode and when no voltage is output from the regulator 115, both the FETs 155 and 157 are rendered OFF, thereby disabling the battery voltage detecting section 150. Hence, the voltage division resistors 158 and 159 do not consume power in vain. The resistors 158 and 159 divides the voltage across the battery 30 and the voltage developed across the resistor 159 is applied to the P8 terminal of the microcomputer 300.

The push switch section 200 includes a push switch 201, resistors 202, 203, diodes 204, 205 and a capacitor 206. When the tool 1 is pressed against the workpiece W and the push switch 201 is turned ON, a LOW signal is applied to the P20 terminal of the microcomputer 300. The push switch 201 and the trigger switch 251 are provided in positions apart from the substrate of the control circuit 51 and these switches are connected to the relevant positions using cables.

Here, a problem arises such that the cables pick up noises produced at the time of ignition, resulting in a voltage induced on the cables, which causes the ground side of the push switch 201 to be positive in polarity. The diodes 204, 205 are provided so that the induced voltage is applied thereto. Thus, an unduly high voltage can be prevented from being applied to the microcomputer 300.

The trigger switch section 250 includes resistors 252, 253, diodes 254, 255 and a capacitor 256, and operates in a similar fashion to the push switch section 200.

The microcomputer 300 has a reset input port 301, an output port 302, a central processing unit (CPU) 303, a RAM 304, a ROM 305, an analog-to-digital (A/D) converter 306, an output port 307, a timer 308, and an input port 309. The microcomputer 300 controls rotation of the motor 3 and operation of the ignition circuit 450. An oscillator 310 disposed outside the microcomputer 300 is connected to the timer 308. While the second embodiment uses the microcomputer 300, a digital circuit may be employed in lieu of the microcomputer 300 to achieve the same job imposed on the microcomputer 300.

The charging circuit section 400 is provided for charging an ignition capacitor 401 and includes the ignition capacitor 401, a transformer 403, diodes 402, 404, 406, transistors 408, 411, an FET 405, and resistors 403, 407–410, 412, 413. Charging the capacitor 401 is commenced when the trigger switch 251 is turned ON. An ON signal issued from the trigger switch 251 is transmitted via two paths to the charging circuit 400. The first path includes a route A indicated in FIG. 6B wherein the ON signal is applied to the base of the transistor 411 to render the latter ON and is thus transmitted to the collector of the transistor 408. On the other hand, the ON signal transmitted via the second path is applied to the P19 terminal of the microcomputer 300. Upon receipt of the ON signal, the microcomputer 300 outputs a LOW signal intermittently from the P11 terminal to the base of a transistor 408, thereby ON/OFF switching the transistor 408. The ON signal transmitted via the two paths causes the FET 405 to perform ON/OFF switching. As a result, a high voltage is developed across the secondary side of the transformer 403, and the ignition capacitor 401 is charged thereby.

As described above, the charging circuit 400 does not start charging the ignition capacitor 401 if the trigger switch 250 is held OFF. This is true even if a voltage developed by a noise is applied to the P19 terminal of the microcomputer 300 and a charge signal is output from the microcomputer 300 instructing to charge the ignition capacitor 401.

The ignition circuit 450 includes an ignition plug 15, a thyristor 457, a transistor 453, a diode 458, and resistors 451, 452, 454, 456. A LOW signal is output from the P9 terminal of the microcomputer 300 as an ignition signal, which signal renders the transistor 453 ON. A gate signal is applied to the gate of the thyristor 457 to render the latter ON. When the thyristor 457 is turned ON, electric charges retained in the ignition capacitor 401 are discharged. As a result, the voltage across the secondary side of the transformer 459 is boosted up to about 15,000 V, causing the ignition plug 15 to ignite. The microcomputer 300 operates to apply the ON signal to the gate of the thyristor 457 for 10 milliseconds after the ignition circuit is rendered operative.

The motor driving controlling section 500 includes a first-stage driving circuit 510 used when starting up the motor 3, a second-stage driving circuit 540 used when the motor 3 rotates at a steady condition, and a third-stage driving circuit 570 used at the time of scavenging. The motor driving controlling section 500 operates when the tool 1 is pressed against the workpiece W and the push switch 201 is turned ON.

The first-stage driving circuit 510 includes transistors 514 through 516 and resistors 511 through 513. When the push switch 201 is turned ON, the microcomputer 300 outputs a LOW signal from the P10 terminal, which renders the transistor 514 OFF and the transistors 515 and 516 ON. As a result, the motor 3 is applied with the battery voltage (7.2 V).

The second-stage driving circuit 540 and the third-stage driving circuit 570 operate in a similar fashion. However, these driving circuits output different voltages to be applied to the motor 3 depending on the base voltages of the transistors 550, 580. Specifically, the second-stage driving circuit 540 outputs 6 V and the third-stage driving circuit 570 outputs 5 V.

Figure 7:
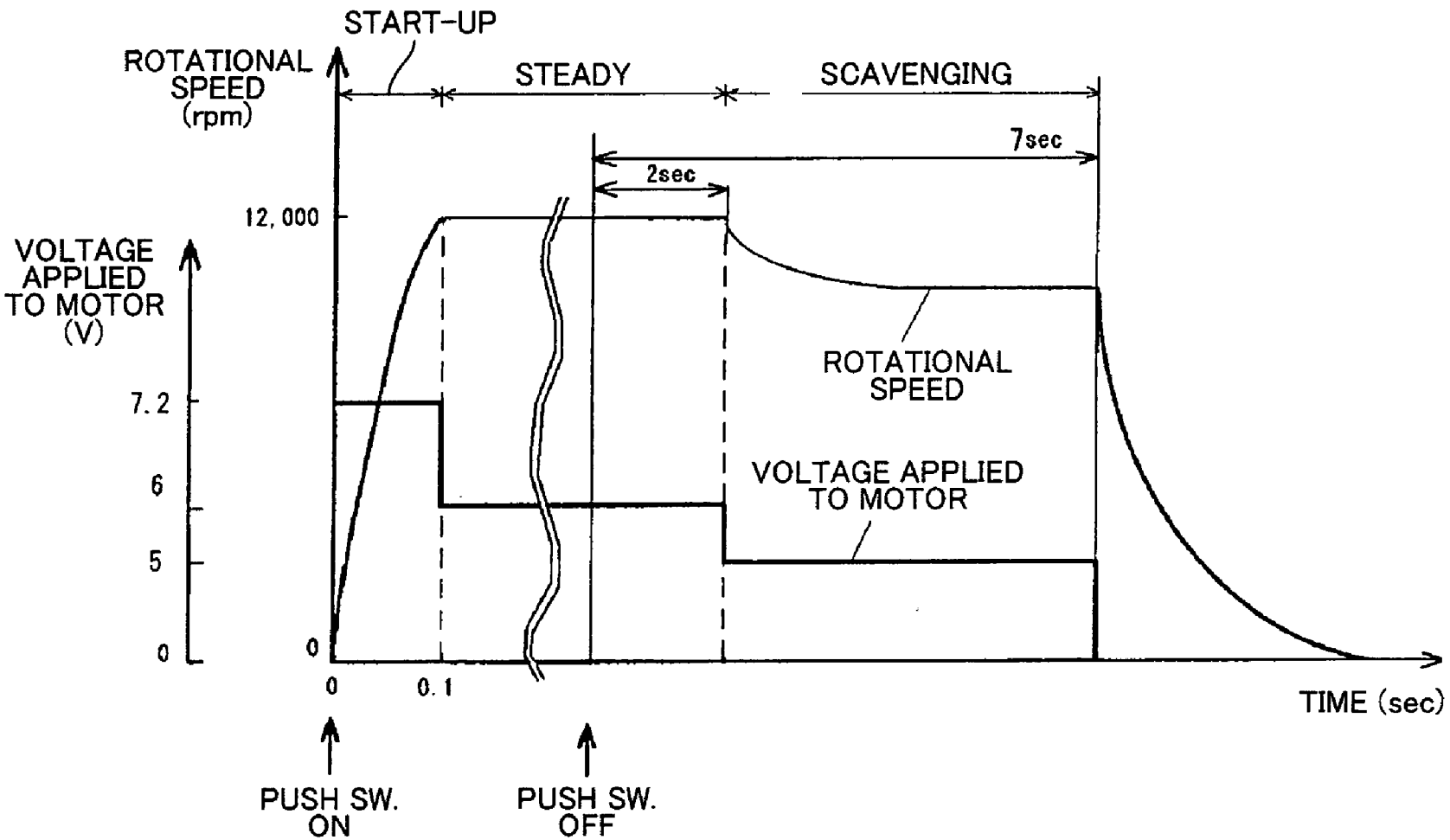
FIG. 7 is a time chart showing the changes in voltage applied to the motor and the rotational speed of the motor when using the circuit in FIGS. 6A and 6B.

FIG. 7 is a time chart showing changes in voltage applied to the motor 3 and the rotational speed of the motor 3 in accordance with the second embodiment of the invention. When the tool 1 is pressed against the workpiece W, flammable gas is injected into the combustion chamber 26 from the gas tank 5 and the push switch 201 is turned ON. Air and flammable gas are mixed through agitation. Early start of agitation ensures explosive combustion and the nail driving operation can be performed without fail. After driving a nail into the workpiece W, the tool 1 is separated from the workpiece W. The motor 3 continues rotating even after the tool 1 is separated from the workpiece W for the purpose of scavenging exhaust gas and cooling the cylinder 20.

As shown in FIG. 7, the voltage applied to the motor 3 changes in three steps. Specifically, the voltage applied to the motor 3 at the time of start-up (hereinafter referred to as "first-stage voltage") is the highest, the voltage applied to the motor 3 during a steady condition (hereinafter referred to as "second-stage voltage") is the second highest, and the voltage applied to the motor 3 at the time of scavenging (hereinafter referred to as "third-stage voltage") is the lowest. The relationship among the first-stage, second-stage and third-stage voltages is not limited to that shown in FIG. 7 but can be such a relationship that the first-stage voltage is equal to or greater than the second-stage voltage, and the second-stage voltage is equal to or greater than the third-stage voltage. However, the first-stage, second-stage and third-stage voltages must not be equal to each other. By establishing the above-described relationship, air and flammable gas can be quickly mixed through agitation at the time of start-up of the motor 3. After air and flammable gas are well mixed, the motor 3 is driven at a constant top speed to achieve a steady condition. At the time of scavenging, the motor 3 is driven at a possible minimum speed to make the exhaust gas scavenge and the cylinder 20 cool down. With the control of the motor 3 as described above, explosive force can be sufficiently strong and the dissipation of the battery 30 can be reduced.

It should be noted that driving the fan 14 is performed irrespective of ON/OFF of the trigger switch 250 but performed depending solely on the operation of the push switch 201. Similarly, charging and igniting operations are performed irrespective of ON/OFF of the push switch 201 but performed depending solely on the operation of the trigger switch 250. As such, even if flammable gas injected into the combustion chamber 26 is not sufficiently vaporized and mixed with air due to circumferential temperature and/or inner pressure of the gas tank 5, ignition to the flammable gas can be achieved by triggering the trigger switch 251 several times while pressing the tool 1 against the workpiece W.

Referring back to FIG. 6B, the display section 600 includes an LED 601 and resistors 602 and 603. When the battery 3 is loaded into the tool 1 and the main switch 101 is turned ON, HIGH and LOW signals are cyclically generated from the P16 terminal of the microcomputer 300 and a LOW signal is generated from the P15 terminal of the microcomputer 300. Thus, the LED 601 flickers with green light to thereby indicate the operator that the tool 1 is in a usable condition. When the tool 1 is pressed against the workpiece W and the motor 3 is driven, the microcomputer 300 generates a LOW signal from the P15 terminal and a HIGH signal from the P16 terminal. Then, the LED 601 is continuously lit with green light to thereby indicate the operator that the nail driving operation can be started. When the battery voltage is not at a nominal level and the control circuit 51 is not in the low power consumption mode, the microcomputer 300 generates a HIGH signal from the P15 terminal and a LOW signal from the P16 terminal. Then the LED 601 is lit with red light to thereby alert the operator that the battery 30 needs charging.

Figure 8:
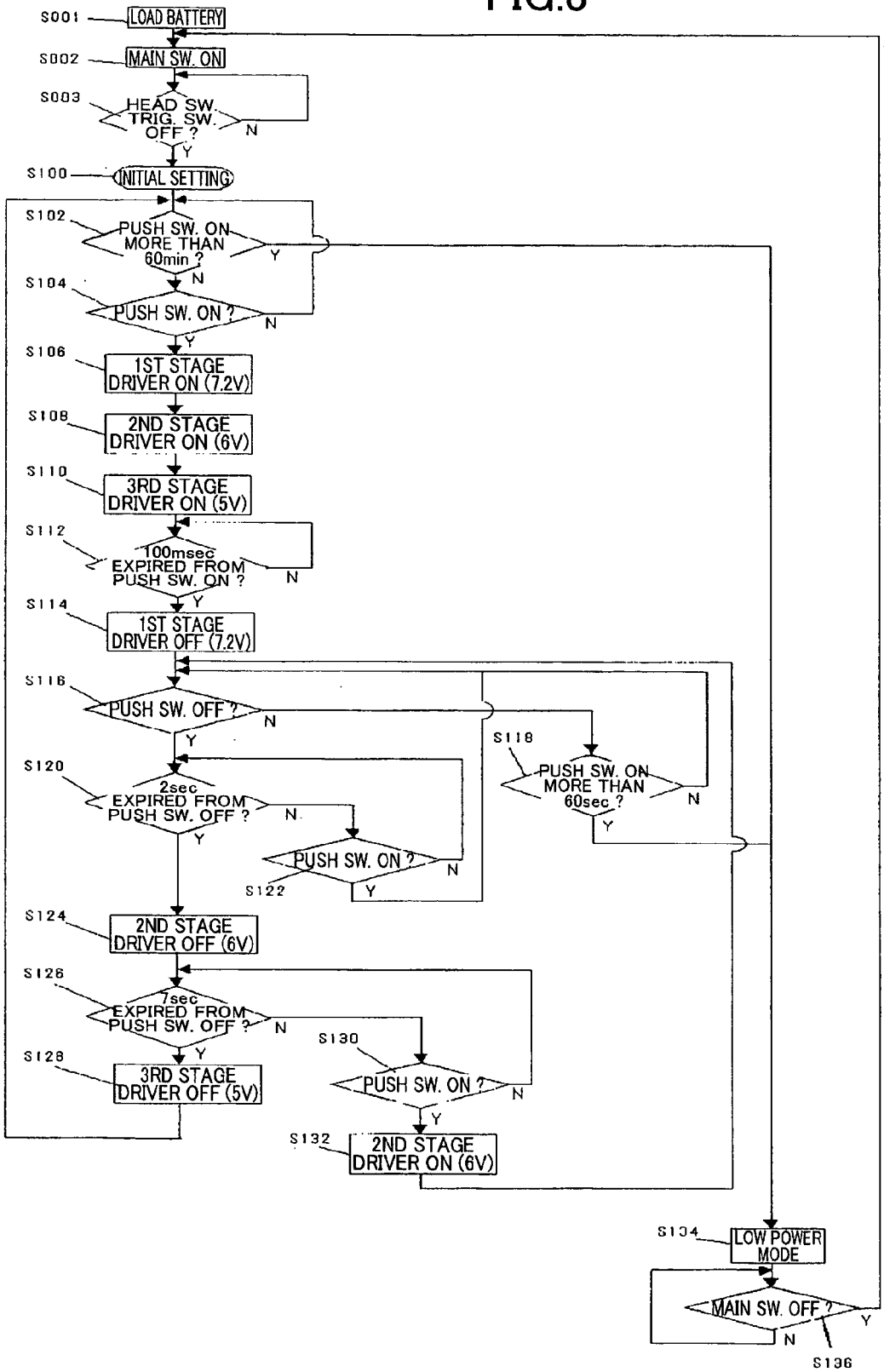
FIG. 8 is a flowchart showing control of a head switch when using the circuit in FIGS. 6A and 6B.

Operation of the control circuit 51 will be described while referring to the flowcharts shown in FIGS. 8 and 9. FIG. 8 is a flowchart relating to the push switch 210 and FIG. 9 to the trigger switch 251.

Referring first to the flowchart of FIG. 8, prior to executing initial settings in step (hereinafter abbreviated to "S") 100, the battery 30 is loaded into the tool 1 (S001) and the main switch 101 is turned to ON (S002). Then, it is judged whether both the push switch 201 and the trigger switch 251 are OFF (S003). The purpose for confirming that these two switches are OFF is to see if the switches malfunction. Should either the push switch 201 or the trigger switch 251 be ON at the initial stage of the operation, the contact point of the switch may, for example, be defective. The tool 1 does not operate if both switches are OFF. Specifically, although the main switch 101 is ON and the microcomputer 300 is supplied with power, the microcomputer 300 is rendered inoperative when either the push switch 201 or the trigger switch 251 is ON even if the main switch 101 is ON.

Next, initial settings are executed (S100). After the initial settings are executed, it is judged whether the tool 1 is currently being used (S102). In this embodiment, the tool 1 is determined to be a non-use condition if the duration of time the push switch 201 is continuously OFF continues more than 60 minutes. The purpose for investigating the non-use condition of the tool 1 is to prevent the battery 30 from being unnecessarily dissipated. If the tool 1 is left unused for a long period of time, dissipation of the battery 30 is to be stopped.

When it is judged that the push switch 201 is being OFF for more than 60 minutes (S102:YES), the power source section 100 is switched to the low power consumption mode (S134). In the low power consumption mode, the microcomputer 300 stops its operation. Cancellation of the low power consumption mode can be implemented by turning OFF the main switch 101 to reset the self-holding circuit 130 and then turning the main switch 101 ON again. When the low power consumption mode is canceled, the tool 1 is placed in a usable condition. After the lower power consumption mode is set (S134), the routine waits until the main switch 101 is turned OFF (S136). If the main switch 101 is turned OFF (S136:YES), the routine returns to S002.

If the push switch 201 is not being OFF for more than 60 minutes (S102:NO), then it is judged whether the push switch 201 is turned ON (S104). When the push switch 201 is turned ON (S104:YES), the motor drive controlling section 500 is energized to drive the fan 14. The rotation of the fan 14 mixes air and flammable gas injected into the combustion chamber 26 through agitation. In this embodiment, when the push switch 201 is turned ON, all of the motor driving circuits 510, 540 and 570 are driven (S106, S108, S110). The voltage applied to the motor 3 in this situation is equal to the voltage across the battery 30, i.e., 7.2V.

Next, it is judged whether 100 milliseconds have been expired from the timing when the push switch 201 is turned ON (S 112). The time of 100 milliseconds is considered to be sufficient duration for the motor 3 to reach to a steady rotational speed. If 100 milliseconds have been expired (S112:YES), then the first-stage driving circuit 510 is turned OFF. As a result, the voltage applied to the motor 3 is decreased to 6V. The motor 3 continues rotating at the steady rotational speed.

Next, it is judged that the tool 1 is separated from the workpiece W by detecting that the push switch 201 is turned OFF (S116). If separation of the tool 1 from the workpiece W is detected (S116:YES), then it is judged whether or not 2 seconds have been expired from the time when the tool 1 is separated from the workpiece W (S120). When 2 seconds have been expired (S120:YES), then the second-stage driving circuit 540 is turned OFF (S124). As a result, the voltage applied to the motor 3 is decreased to 5V and the rotational speed of the motor 3 is decreased.

By preserving 2 second waiting time in S120, the change in the rotational speed of the motor 3 can be prevented even if the push switch 201 is momentarily turned OFF during this period due to reaction of the tool 1. Thus, generation of beats caused by the change in the rotational speed of the motor 3 can be prevented. The waiting time in S120 is not limited to 2 seconds but different duration of time may be set.

If the push switch 201 is turned ON during the 2 seconds waiting time (S122:YES), then the routine proceeds via S116 to S118 where it is judged whether or not the ON state of the push switch 201 continues for more than 60 seconds. The purpose for the 60 seconds continuous ON time detection of the push switch 201 in S118 is to prevent an unintentional driving of the motor 3 and dissipation of the battery 30 resulting from the motor driving. The motor 3 is unintentionally driven if the push lever 10 is held in a pressed condition for some reasons. Further, if the push switch 201 is continuously ON for more than 60 seconds, the wired circuit may be short-circuited or the push switch 201 is defective. Accordingly, if the push switch 201 is continuously ON for more than 60 seconds (S118:YES), then the low power consumption mode is set (S134). On the other hand, if the push switch 201 is not continuously ON for more than 60 seconds (S118:NO), then the routine returns to S116. It is not intended to limit the duration of time for the continuous ON time detection of the push switch 201 in S118 to 60 minutes but different duration of time can be set.

After the second-stage driving circuit 540 is turned OFF (S124), it is judged whether or not 7 seconds have been expired from the time when the push switch 201 is turned OFF (S126). When the push switch 201 is turned OFF, that is, when the tool 1 is separated from the workpiece W, the combustion chamber 26 is in fluid communication with atmosphere. The motor 3 is forcibly driven for 7 second after the push switch 201 is turned OFF to scavenge the exhaust gas and cool the cylinder 20.

If the push switch 201 is turned ON before expiration of 7 seconds (S130), it is determined that the nail driving operation is again performed. Accordingly, the second-stage driving circuit 540 is again turned ON to apply 6V to the motor 3. When 7 seconds have been expired from the time when the push switch 201 is turned OFF (S126:YES), then the third-stage driving circuit 570 is turned OFF (S128) to thereby stop driving the motor 3, whereupon the routine returns to S102.

Figure 9:
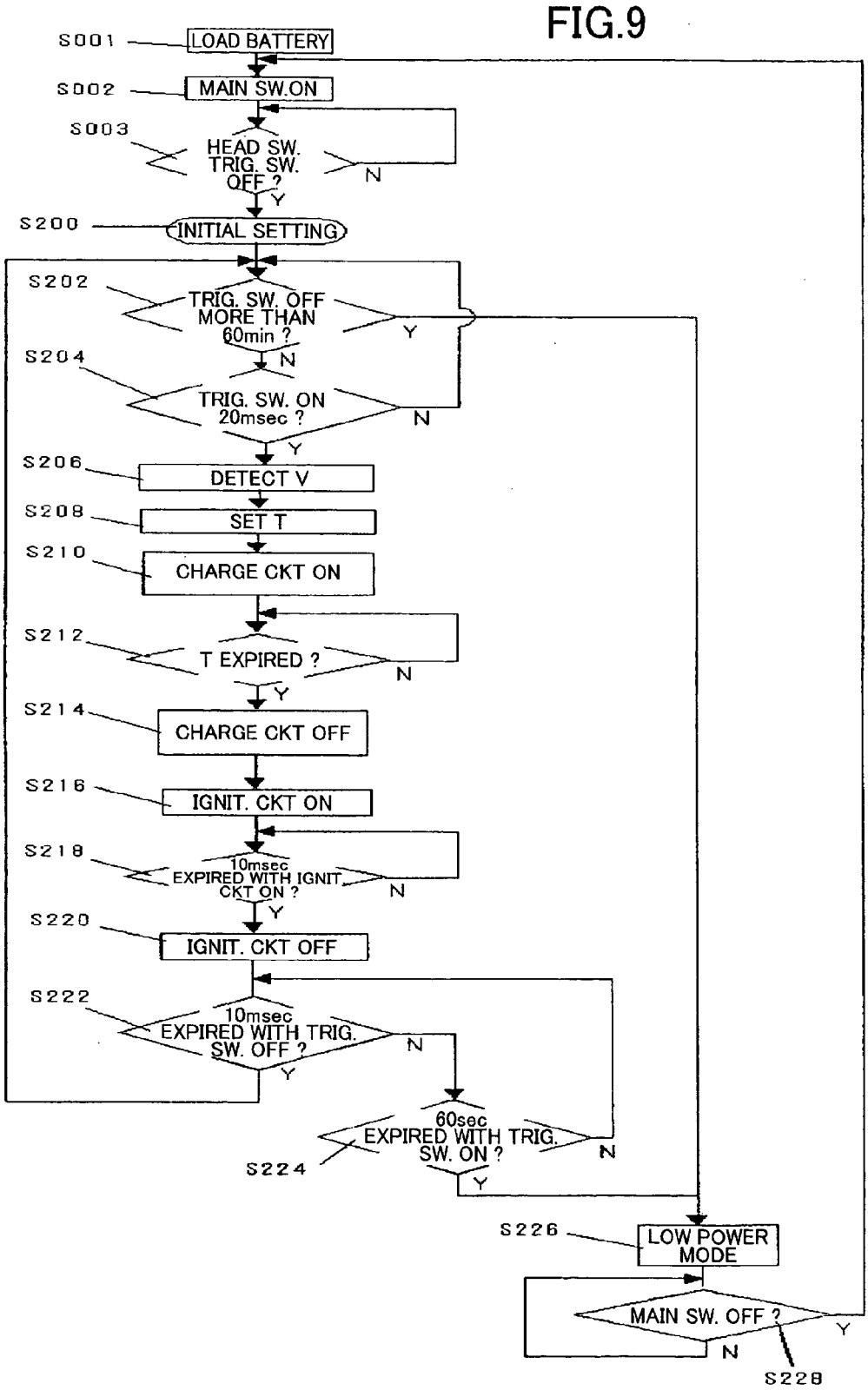
FIG. 9 is a flowchart showing control of a trigger switch when using the circuit in FIGS. 6A and 6B.

Referring next to the flowchart of FIG. 9, the battery 30 is loaded into the tool 1 (S001) and the main switch 101 is turned ON (S002). Next, it is judged whether both the push switch 201 and the trigger switch 251 are OFF (S003). If both of the push switch 201 and the trigger switch 251 are OFF (S003:YES), then initial settings are performed (S200).

After the initial settings are performed, it is judged whether or not the trigger switch 251 is continuously OFF for more than 60 minutes (S202). If the judgement in S202 is affirmative (S202:YES), the tool 1 is determined to be in a non-use condition. Therefore, the power source section 100 is set to the low power consumption mode (S226). When the main switch 101 is turned OFF (S228:YES), the routine returns to S002.

When judgement in S202 indicates that the tool 1 is in use condition (S202:NO), then it is judged whether the operator triggers the trigger switch 251. If the trigger switch 251 is continuously ON for 20 milliseconds (S204:YES), it is determined that the trigger switch 251 is triggered. Chattering caused by vibration of the tool 1 may turn the trigger switch 251 ON. However, generally, the ON duration of the trigger switch 251 does not last 20 milliseconds, therefore, S204 can detect only when the operator triggers the trigger switch 251.

When it is detected that the operator triggers the trigger switch 251, the voltage V across the battery 30 is detected (S206). Depending on the detected battery voltage V, a charge time T for charging the ignition capacitor 401 is determined (S208). The charge time T is set to longer if the battery voltage V is lowered. Then, the charging circuit section 400 is turned ON to start charging the ignition capacitor 401 for duration of time T set in S208.

When the charge time T has been expired (S212:YES), then the charging circuit section 400 is turned OFF (S214). After charging the ignition capacitor 401 is complete, the ignition circuit section 450 is turned ON for 10 milliseconds (S216, S218) to ignite the mixture of flammable gas and air with the spark of the ignition plug 15. After the ignition is performed, the ignition circuit section 450 is turned OFF (S220).

Next, it is judged whether the trigger switch 251 is turned OFF. In order to exclude influence of chattering, whether the trigger switch 251 is continuously OFF for 10 milliseconds is detected (S222). When the trigger switch 251 is OFF (S222:YES), then the routine returns to S202. On the other hand, when the trigger switch 251 is ON (S222:NO), it is judged whether or not the trigger switch 251 is continuously ON for more than 60 seconds (S224). If the judgement in S224 is affirmative, it is assumed that the trigger switch 251 is defective for some reasons. Accordingly, the power source section 100 is set to the low power consumption mode (S226) to stop the operation of the microcomputer 300. After the low power consumption mode is set, the routine returns to S002 if the main switch 101 is turned OFF (S228:YES).

Two pieces of programs corresponding to the flowcharts in FIGS. 8 and 9 are run separately on the same time base. It should be noted that when the trigger switch is turned ON while the push switch is OFF, the liquefied gas is not injected into the combustion chamber. Accordingly, the fastener is prevented from accidentally driven into the workpiece even if the ignition is taken place.

Although the present invention has been described with respect to specific embodiments, it will be appreciated by one skilled in the art that a variety of changes and modifications may be made without departing from the scope of the invention. For example, certain features may be used independently of others and equivalents may be substituted all within the scope of the invention.

What is claimed is:

1. A combustion-powered driving tool for driving fasteners into a workpiece, comprising:

a housing having a first end and a second end opposite the first end;

a head section for fixing to the first end of the housing and having a flammable gas channel formed therein;

a motor;

a battery for supplying an operating voltage;

a motor drive controlling section that is supplied with the operating voltage of the battery and controls a voltage applied to the motor;

a cylinder;

a piston slidably movably disposed inside the cylinder;

a combustion chamber frame that moves to contact and separate from the head section and that forms a combustion chamber together with the head section, the cylinder, and the piston when the combustion chamber frame is in contact with the head section;

a fan rotatably disposed in the combustion chamber and driven to rotate by the motor; and a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston, wherein the motor drive control section applies a first voltage to the motor when the combustion chamber is formed by the combustion chamber frame moving toward and brought into contact with the head section, and a second voltage to the motor, the first voltage being greater than the second voltage.

2. The combustion-powered driving tool according to claim 1, wherein the motor drive controlling section comprises an up converter that steps up the operating voltage of the battery and outputting a stepped up voltage, wherein the motor drive controlling section applies the stepped up voltage to the motor as the first voltage.

3. The combustion-powered driving tool according to claim 2, wherein the motor drive controlling section applies the operating voltage of the battery to the motor as the second voltage.

4. The combustion-powered driving tool according to claim 1, wherein the motor drive controlling section comprises a down converter that steps down the operating voltage of the battery and outputting a stepped down voltage, wherein the motor drive controlling section applies the stepped down voltage to the motor as the second voltage.

5. The combustion-powered driving tool according to claim 4, wherein the motor drive controlling section applies the operating voltage of the battery to the motor as the first voltage.

6. The combustion-powered driving tool according to claim 1, wherein with the first voltage applied to the motor, the motor reaches to the steady rotational speed within 130 ms.

7. The combustion-powered driving tool according to claim 1, wherein the motor drive control section applies a third voltage to the motor after the explosive combustion is taken place, the second voltage being greater than the third voltage.

8. A combustion-powered driving tool for driving fasteners into a workpiece, comprising:

a housing having a first end and a second end opposite the first end;

a head section for fixing to the first end of the housing and having a flammable gas channel formed therein;

a motor;

a battery for supplying an operating voltage;

a power source section that is supplied with the operating voltage of the battery and generates a reference voltage;

a motor drive controlling section that is supplied with the operating voltage of the battery and the reference voltage from the power source section and that drives the motor based on the operating voltage and the reference voltage;

a first switch that detects whether the tool is pressed against the workpiece and outputs a first signal indicative of a detected condition;

a second switch that instructs driving the fastener into the workpiece and outputs a second signal indicative of an instruction to drive the fastener;

a cylinder;

a piston slidably movably disposed inside the cylinder;

a combustion chamber frame that moves to contact and separate from the head section and that forms a combustion chamber together with the head section, the cylinder, and the piston when the combustion chamber frame is in contact with the head section;

a fan rotatably disposed in the combustion chamber and driven to rotate by the motor;

a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston; and a controller that controls the power source section not to generate the reference voltage in order to reduce power consumption when at least one of the first signal and the second signal indicates that the tool is left unused for a prescribed period of time.

9. The combustion-powered driving tool according to claim 8, wherein the controller further controls the power source section not to generate the reference voltage in order to reduce power consumption when at least one of the first signal and the second signal indicates that at least one of the first switch and the second switch malfunctions.

10. The combustion-powered driving tool according to claim 8, wherein the motor drive control section applies a first voltage to the motor when the combustion chamber is formed by the combustion chamber frame moving toward and brought into contact with the head section, and a second voltage to the motor after the motor has reached a steady rotational speed, the first voltage being greater than the second voltage.

11. The combustion-powered driving tool according to claim 10, wherein the motor drive control section applies a third voltage to the motor after the explosive combustion is taken place, the second voltage being greater than the third voltage.

12. A combustion-powered driving tool for driving fasteners into a workpiece, comprising:

a housing having a first end and a second end opposite the first end;

a head section for fixing to the first end of the housing and having a flammable gas channel formed therein;

a motor;

a battery for supplying an operating voltage;

a power source section that is supplied with the operating voltage of the battery;

a motor drive controlling section that is supplied with the operating voltage of the battery and drives the motor;

a first switch that detects whether the tool is pressed against the workpiece and outputs a first signal indicative of a detected condition;

a second switch that instructs driving the fastener into the workpiece and outputs a second signal indicative of an instruction to drive the fastener;

a cylinder;

a piston slidably movably disposed inside the cylinder;

a combustion chamber frame that moves to contact and separate from the head section and that forms a combustion chamber together with the head section, the cylinder, and the piston when the combustion chamber frame is in contact with the head section;

a fan rotatably disposed in the combustion chamber and driven to rotate by the motor;

a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston; and a controller that actuates the sparkplug to ignite the mixture of air and flammable gas in the combustion chamber in response to the second signal and regardless of the first signal.

13. A combustion-powered driving tool for driving fasteners into a workpiece, comprising:

a housing having a first end and a second end opposite the first end;

a head section for fixing to the first end of the housing and having a flammable gas channel formed therein;

a motor;

a battery for supplying an operating voltage;

a power source section that is supplied with the operating voltage of the battery and generates a reference voltage;

a motor drive controlling section that is supplied with the operating voltage of the battery and the reference voltage from the power source section and that drives the motor based on the operating voltage and the reference voltage;

a first switch that detects whether the tool is pressed against the workpiece and outputs a first signal indicative of a pressed condition of the tool;

a second switch that instructs driving the fastener into the workpiece and outputs a second signal indicative of an instruction to drive the fastener;

a third switch that connects the battery and the power source section when turned ON;

a cylinder;

a piston slidably movably disposed inside the cylinder;

a combustion chamber frame that moves to contact and separate from the head section and that forms a combustion chamber together with the head section, the cylinder, and the piston when the combustion chamber frame is in contact with the head section;

a fan rotatably disposed in the combustion chamber and driven to rotate by the motor;

a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston; and a controller that is supplied with the reference voltage from the power source section when the third switch is ON, wherein the controller is rendered inoperative when neither the first signal nor the second signal is output even if the third switch is ON.

14. A combustion-powered driving tool for driving fasteners into a workpiece, comprising:

a housing having a first end and a second end opposite the first end;

a head section for fixing to the first end of the housing and having a flammable gas channel formed therein;

a motor;

a battery for supplying an operating voltage;

a power source section that is supplied with the operating voltage of the battery and generates a reference voltage;

a motor drive controlling section that is supplied with the operating voltage of the battery and the reference voltage from the power source section and that drives the motor based on the operating voltage and the reference voltage;

a first switch that detects whether the tool is pressed against the workpiece and outputs a first signal indicative of a pressed condition of the tool;

a second switch that instructs driving the fastener into the workpiece and outputs a second signal indicative of an instruction to drive the fastener;

a cylinder;

a piston slidably movably disposed inside the cylinder;

a combustion chamber frame that moves to contact and separate from the head section and that forms a combustion chamber together with the head section, the cylinder, and the piston when the combustion chamber frame is in contact with the head section;

a fan rotatably disposed in the combustion chamber and driven to rotate by the motor;

a sparkplug exposed in the combustion chamber for igniting a mixture of air and flammable gas in the combustion chamber, the flammable gas being supplied into the combustion chamber via the flammable gas channel, wherein explosive combustion caused by firing of the sparkplug moves the piston toward the second end of the housing and a fastener is driven into the workpiece in accordance with the movement of the piston; and a controller that generates a start signal instructing to drive a fastener into the workpiece, wherein the fastener is driven into the workpiece when both the second signal and the start signal are generated.

* * * * *